United States Patent [19]

Rubik

[11] Patent Number: 4,471,959

[45] Date of Patent: Sep. 18, 1984

[54] LOGICAL TOY

[76] Inventor: Ernő Rubik, II. Bimbóut 210., Budapest, Hungary

[21] Appl. No.: 375,269

[22] PCT Filed: Sep. 1, 1981

[86] PCT No.: PCT/HU81/00035

§ 371 Date: Apr. 27, 1982

§ 102(e) Date: Apr. 27, 1982

[87] PCT Pub. No.: WO82/00772

PCT Pub. Date: Mar. 18, 1982

[30] Foreign Application Priority Data

Sep. 1, 1980 [HU] Hungary ..... 2154/80

[51] Int. Cl.[3] ..... A63F 9/08

[52] U.S. Cl. ..... 273/153 S; 273/281

[58] Field of Search ..... 273/153 S, 271, 281, 273/284; 40/489, 490, 491, 508, 509, 510, 513

[56] References Cited

U.S. PATENT DOCUMENTS

| | | | |
|---|---|---|---|
| 332,211 | 12/1885 | Protheroe | 273/153 S |
| 3,680,867 | 8/1972 | Zimmerman | 40/107 X |
| 4,303,246 | 12/1981 | Strongin | 273/271 |

*Primary Examiner*—Anton O. Oechsle

[57] ABSTRACT

A logical toy for the arrangement in any desired pattern of numerals, figures or other symbols printed on independent game pieces. It contains one or more lower pushers and upper pushers movable perpendicularly thereto in grooves formed on a bearing plate. The number of lower and upper pushers and the number of the game pieces can be varied as desired. The game pieces can be arranged in directions perpendicular to one another by shifting the pushers. The bearing plate and the pushers are sealed in by a transparent plate, or one provided with apertures, which is attached to the bearing plate in a permanent manner.

2 Claims, 11 Drawing Figures

LOGICAL TOY

Figure 1:
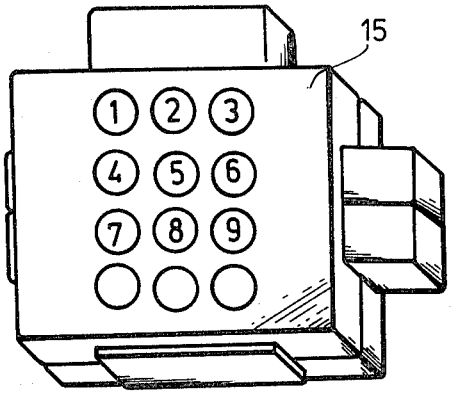

The subject of the invention is a logical toy which consists of a square or oblong bearing plate provided with longitudinal and transverse grooves and with guide blocks rising out of the plane of the plate at the four corners, and of an upper pusher sliding in two directions, whose width is determined by the guide blocks, and furthermore of at least one lower pusher moving perpendicularly to the direction of movement of the upper pusher, and of a certain number of square game pieces, 11 game pieces in a preferred exemplary embodiment, on which numerals, designs or other symbols are printed. The bearing plate forms a single plane with the pushers moving in the grooves and with the independent square game pieces disposed side by side in the recesses of these pushers: the structure consisting of the components assembled in this manner is sealed up by a cover plate provided preferably with circular openings or with openings corresponding to other regular geometrical shapes, or a transparent cover plate having no openings, which is fastened to the bearing plate in a known manner by an unreleasable bond.

In this manner, the square game pieces which can be moved perpendicularly to one another within the flat, oblong structure, and which are shifted about by the pushers in the direction of their movement, are visible through the openings in the cover plate or through the transparent cover plate; and the numerals, designs or symbols can be arranged by operating the pushers in correct logical sequence, in a predetermined order corresponding to the content which the pieces bear in combination.

In a logical toy in accordance with the invention which is constructed according to a preferred exemplary embodiment, at least two of the square game pieces are concealed by the cover plate; thus only nine numbers or designs are visible through the openings in the cover plate. The other three "blind" or "fake" openings are reserved for the combination possibilities resulting from the displacement of the pushers, on the basis of the game pieces which are concealed by the cover plate in the basic position, and which by the manipulation of the pushers are brought under the "windows", i.e., the openings in the cover plate, and by such manipulation can cooperate in the production of the predetermined logical combination, e.g., the configuration of the sequence of the numbers or of a certain picture.

Flat toys which can be carried about in the pocket and are constructed in the form of a quadrilateral body and in which a logical order, e.g., numerical order, can be produced by the displacement of square plates, are already known. Such a toy is, for example, the American toy operating on the principle of the shifting about of square plates and distributed under the name, "Sam Lloyd's Fifteen Puzzle". The square, flat body is divided into squares and fifteen square plates can be shifted about horizontally and vertically. The space of the sixteenth plate is empty; thus, the establishment of the order can be achieved by shifting the square plates about and making proper use of the empty square. The object of the game is the arrangement of the numbers on the plates, in the course of which—that is, in the performance of the steps required for the arrangement—only one plate can be moved away from its space at a time.

It can be proven mathematically that only half of the possible combinations of a set consisting of 15 plates can be achieved by shifting them about using the 15 plates and one empty space.

The purpose of the logical toy in accordance with the invention is therefore the expansion of the combinations achievable by this toy, and the creation of the possibility of making the combinations more changeable. The basic principle departs substantially from that of the known toys having the same purpose.

Figure 4:
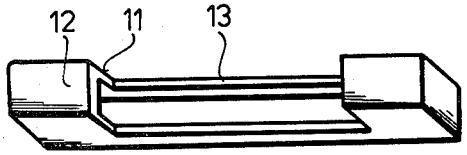
Figure 7:
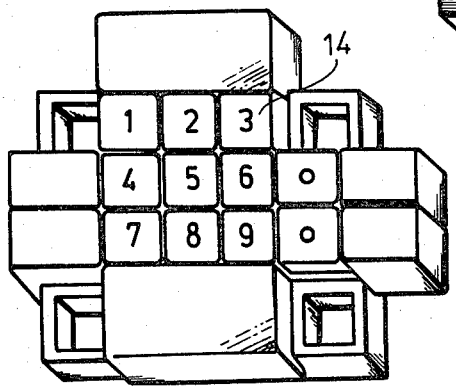
Figure 2:
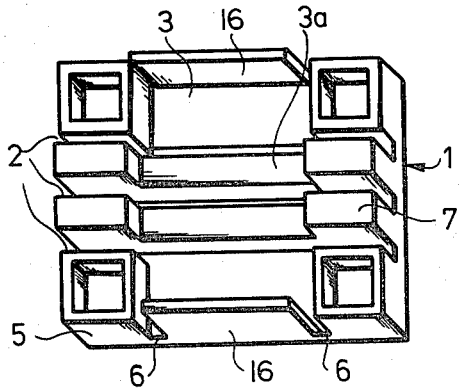
Figure 3:
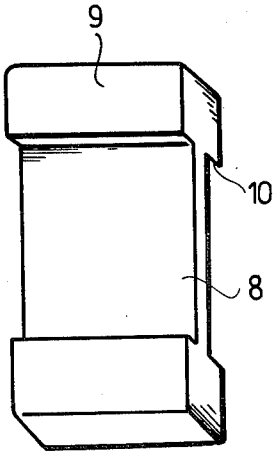
Figure 6:
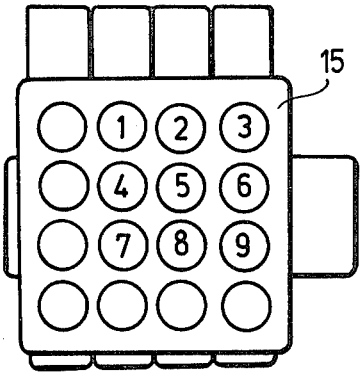
Figure 5:
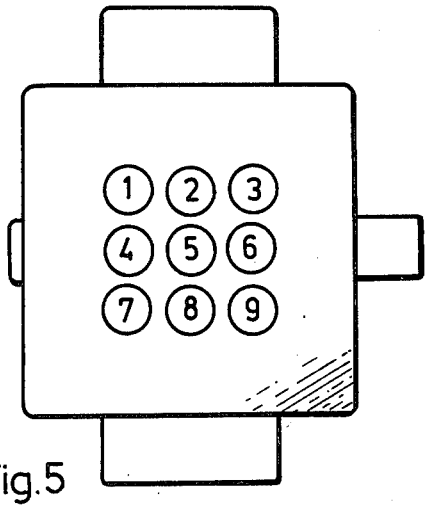
Figure 9:
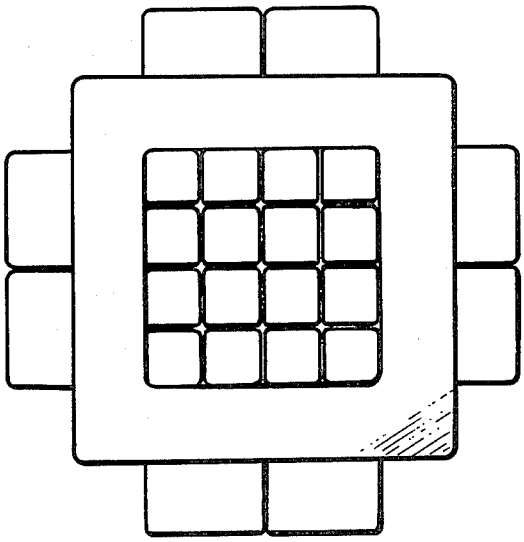
Figure 8:
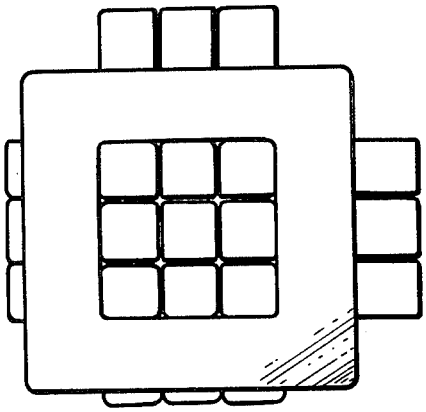
Figure 10A:
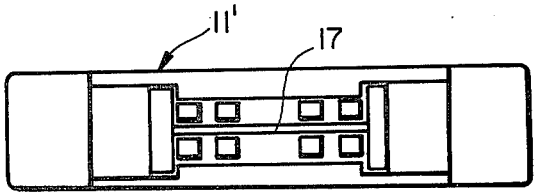
Figure 10:
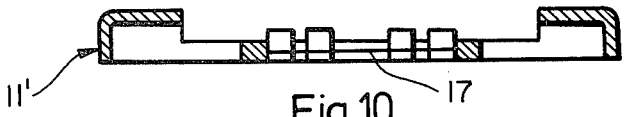

The composition and the inner structure of the toys according to the invention will be described hereinbelow in conjunction with a number of examples, with the aid of the appended drawings. In the drawings, FIG. 1 shows the logical toy in the assembled state, in an exemplary embodiment, FIG. 2 is a view of the bearing plate, FIG. 3 is also a view of the upper slide element, FIG. 4 is a view of one of the lower slides, FIG. 5 is a plan view of the cover plate, FIG. 6 is a toy having 5 pushers and 10 game pieces, FIG. 7 is a logical toy having 3 pushers and 11 game pieces, without cover plate, FIG. 8 shows a logical toy having 6 pushers and 15 game pieces, FIG. 9 is a toy having 4 pushers and 32 game pieces, and finally FIGS. 10 and 10*a* are a view of, and a section through, respectively a pusher provided with a resilient binding element.

The bearing plate 1 is divided by three longitudinal grooves 2 into two wider rectangles 3 and two narrower rectangles 3*a*. The bearing plate 1 itself is also oblong, and on each of its four corners a projecting square block 5 is formed. The base area of the block is the same as that of game pieces 14 described later. On the two shorter sides of the two wider rectangles 3, a total of four short grooves 6 are created, extending all the way to the transverse grooves 2. Likewise on the two ends of each of the inner, narrower rectangles 3*a* separated by grooves 2, oblong stops 7 are formed which project from the level of the rectangles by one-half of the height of the blocks 5. On the bearing plate 1 there is thus formed, perpendicular to the horizontal grooves 2, a slideway on which an upper pusher 8 (FIG. 3) can move vertically above the grooves 2. The upper pusher 8 is so constructed that, at the sides of the rectangle whose width is the same as that of the slideway and whose thickness is the same as that of the bearing plate, an oblong projection 9 corresponding to the length of a row of game pieces is created, so that one of these oblong projections reaches above the slideway of the bearing plate depending on the size of the game pieces. On the bottom surface of the upper pusher 8 three sides of the oblong projection 9 are surrounded by a rim 10 which may abut against the two wider, oblong projections 16 separated by grooves 6 and situated on the bearing plate. Accordingly, the upper pusher cannot fall out of the structure.

In addition to the upper pusher 8, two additional lower pushers 11 are to be found in the structure. These two pushers 11 are shaped such that they can move in the grooves 2, i.e., perpendicularly to the direction of movement of the wider pusher 8. At each end of the lower pushers 11 there is a hood 12 which is open on one side and fits like a cap over the oblong stops 7, and a yoke 13 sliding in the grooves 2 and joining the hoods 12 together.

As a result of this design, the bottom pushers 11 can be shifted to the right and left by a distance corresponding to the basic division, i.e., one side of the game pieces. The upper pusher 8 can move the same distance upwardly and downwardly, perpendicularly to the pushers 11. During assembly, first the bottom pushers 11 are laid in the grooves 2 of the bearing plate 1; then the upper sliding element is placed vertically upon it. The bottom surface of the vertical, recessed portion of the pusher 8 is selected such that on this portion a certain number of game pieces 14, totaling nine in this embodiment, can be disposed, two game pieces 14 being provided in the open space between two blocks 5 on the bearing plate 1 on the lower pushers 11. On the structure composed in this manner there is fastened a cover plate 15 by means of known fastening means which are not removable, such that the numbers, figures or symbols drawn on the play elements 14 are visible through nine apertures in the cover plate, while three openings on the cover plate 15 are "blind" or "fake" openings through which play elements 14 are not visible.

It is obvious that, on the basis of the basic principle of the structure, the toy can also be constructed such that pushers 11 matching the size of the game pieces are disposed for displacement in the grooves in the bearing plate, i.e., pushers 11 of uniform width. It is also obvious that each end of the pushers extends beyond the edge of the bearing plate 1. The arrangement of the upper and lower pushers can also be varied in number and division. A number of possible constructions are shown in the examples in FIGS. 6, 7, 8 and 9. From these embodiments it is clearly evident that the system of the invention creates the possibility of selecting any desired number of playing elements, depending on the purpose for which they are to be used, and that the pushers of uniform width moving parallel to one another can be joined together however desired, thereby making it possible to increase the difficulty or complexity of the game.

Another possibility (shown in FIGS. 10 and 10*a*) is to provide between the hood-like ends of the playing elements a joining element 17 made from an elastic material, such as a rubber band, whose two stiff ends are disposed in the trough of the pushers 11′. These elastic joining elements permit the pusher to be shifted in either direction by a distance corresponding to one unit, and then they restore it to its initial position. The pushers of the logical toy constructed in accordance with the present embodiment are to be displaced in only one direction; the next (restoring) movement is performed by the elastic joining element, e.g., rubber band. The performance of the manual steps can be accelerated in this manner.

The logical toy of the invention operates as follows: By the displacement of one of the lower pushers 11, a total of four game pieces—if the logical toy has 4 game pieces in a row—can be moved in one direction (of these, three are visible through the openings in the cover plate 15, the fourth is concealed). By the manipulation of the two lower pushers 11, the advancement of a total of eight game pieces 14 in the same or in opposite directions is made possible. The upper pusher 8 can move a total of nine visible game pieces perpendicularly to the direction of movement of the lower pushers 11.

On the basis of the above it is obvious that an extraordinarily great number of combinations can be produced by such manipulation. One game object, for example, if the playing elements are marked with numbers, is to arrange the numbers in a predetermined order. The one who achieves the arrangement of the numbers with the fewest moves wins the game. The playing elements can, of course, contain designs or other symbols which, after they have been moved in the predetermined logical sequence, constitute a desired pattern or picture.

The logical toy constructed in accordance with the invention makes possible numerous combinations and variations. It develops logical thinking, and especially challenges growing children to think of how to perform a minimum number of logical steps.

The logical toy in accordance with the invention is furthermore suitable for the simpler and more economical achievement of the mosaic patterns produced by electrical circuits as known in the advertising field.

I claim:

1. Logical toy for the grouping together of a certain number of game pieces which are visible in the basic position and a certain number of invisible game pieces containing numbers, figures or other symbols, comprising: a bearing plate having a base plane and also having a plurality of mutually perpendicular grooves disposed in said base plane, rectangles separated by the grooves and projecting from the base plane, and blocks extending from the base plane at the four corners thereof; first pushing means disposed in the grooves for horizontal displacement, and second pushing means disposed above said first pushing means perpendicular thereto and guided by the blocks; a certain number of essentially square game pieces disposed on said second pushing means; and a cover plate, provided with openings or transparent windows, fastened unreleasably to the bearing plate and covering said bearing plate, pushing means and game pieces.

2. Logical toy of claim 1, wherein the number and arrangement both of the game pieces and of the first and second pushing means is variable.

* * * * *